United States Patent [19]

Feichtlbauer

[11] Patent Number: 4,714,266

[45] **Date of Patent: * Dec. 22, 1987**

[54] SKI RUNNING-SURFACE PLASTIC COATING

[75] Inventor: Werner Feichtlbauer, Antiesenhofen, Austria

[73] Assignee: Trak Incorporated, Wardhill, Mass.

[ * ] Notice: The portion of the term of this patent subsequent to Jan. 21, 2003 has been disclaimed.

[21] Appl. No.: 785,568

[22] Filed: Oct. 7, 1985

[30] Foreign Application Priority Data

Oct. 9, 1984 [AT] Austria ..... 3188/84

[51] Int. Cl.[4] ..... A63C 5/00

[52] U.S. Cl. ..... 280/604; 156/250

[58] Field of Search ..... 280/604, 610; 156/250

[56] References Cited

U.S. PATENT DOCUMENTS

| | | | |
|---|---|---|---|
| 2,142,459 | 1/1939 | Sahuy | 280/604 |
| 2,914,335 | 11/1959 | Rivard | 280/604 |
| 3,408,086 | 10/1968 | Bennett | 280/604 |
| 3,858,894 | 1/1975 | Ver et al. | 280/604 |
| 4,118,050 | 10/1978 | Schnurrenberger | 280/610 X |
| 4,223,909 | 9/1980 | Danner et al. | 280/604 |
| 4,320,908 | 3/1982 | Ellingsen et al. | 280/604 |
| 4,585,249 | 4/1986 | Plenk | 280/609 |

FOREIGN PATENT DOCUMENTS

| | | | |
|---|---|---|---|
| 203405 | 5/1957 | Austria | 280/604 |
| 2949688 | 6/1981 | Fed. Rep. of Germany | 280/604 |
| 2724711 | 10/1984 | Fed. Rep. of Germany . | |
| 2307559 | 11/1976 | France | 280/604 |
| 579932 | 9/1976 | Switzerland | 280/604 |
| 473231 | 11/1937 | United Kingdom | 280/604 |

OTHER PUBLICATIONS

Völkl, EPO, 0033864, Aug. 81.

*Primary Examiner*—Nancy A. Swisher

*Attorney, Agent, or Firm*—Karl F. Ross; Herbert Dubno

[57] ABSTRACT

A running-surface plastic coating for skis which comprises a running surface forming a climbing aid and having a multiplicity of teeth which are aligned in the longitudinal direction of the ski and terminate towards the rear end of the ski in a pointed end capable of being bent upwards, said teeth being defined by two families of parallel running-surface cuts intersecting each other in the running surface, the individual families of cuts being inclined to a normal of the running surface in opposite directions wherein the running surface cuts at least substantially have the shape of circular segments and include an angle of at least 60° with a running-surface normal, and that the relative spacing of the running-surface cuts is at most 1 mm.

12 Claims, 8 Drawing Figures

FIG.1
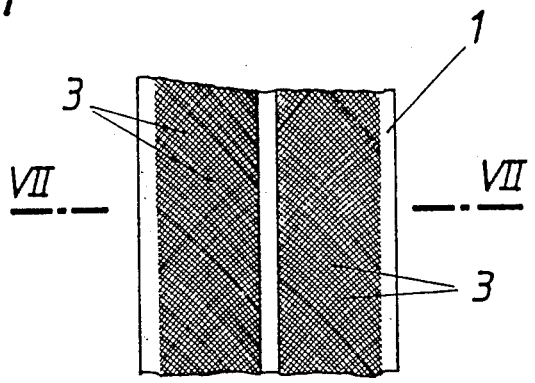
FIG. 2
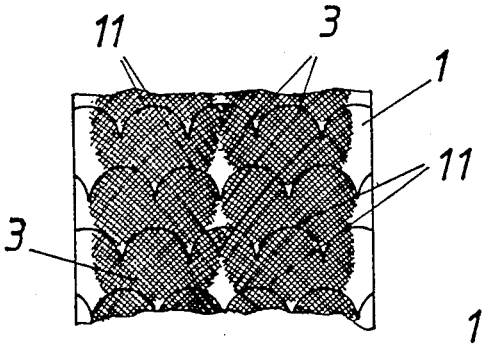
FIG. 3
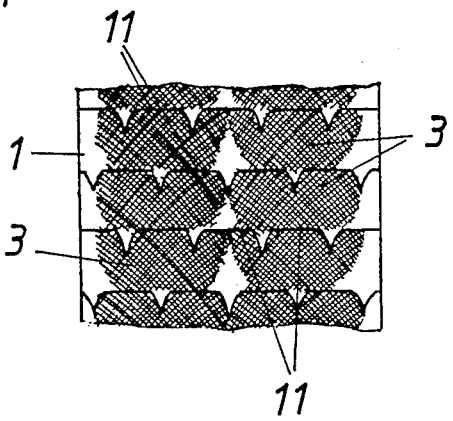
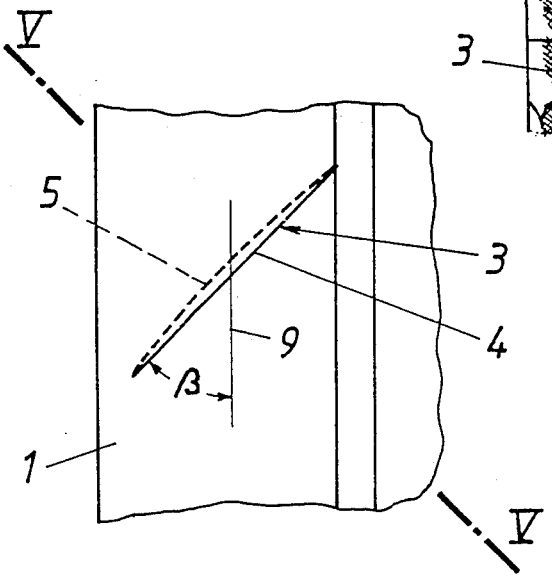
FIG.4

SKI RUNNING-SURFACE PLASTIC COATING

CROSS REFERENCE TO RELATED APPLICATION

This application is related to the commonly owned co-pending application Ser. No. 665,627 filed Oct. 29, 1984, now U.S. Pat. No. 4,565,387, which is hereby incorporated in its entirety by reference.

FIELD OF THE INVENTION

My present invention relates to a running-surface plastic (synthetic-resin) coating for skis which comprises a running surface forming a climbing aid and having a multiplicity of teeth which are aligned in the longitudinal direction of the ski and terminate towards the rear end of the ski in a pointed end capable of being bent upwards, the teeth being defined by two families of parallel running-surface cuts intersecting each other in the running surface, the individual families of cuts being inclined to a normal of the running surface in opposite directions.

BACKGROUND OF THE INVENTION

It has been known in cross-country skis to provide the running surface in the central longitudinal region with a scale-like structure so as to obtain a sawtooth-shaped extension with a multiplicity of scales whose backs rise gently towards the rear end of the ski and are defined by steep faces, the array of which provides an increased sliding resistance when the ski moves oppositely to the running direction. However, regardless of the shape and the distribution of the scales, an increased sliding resistance in the running direction also has to be accepted with running surfaces having such a structure.

For increasing the climbing aid achievable with a scale-like structure of the running surface, it has been known (German Laid-Open Patent Application No. 27 23 176) to design the scales in the form of teeth or tongues having ends which are capable of being bent upwards so that upon back-sliding of the ski the sliding resistance is increased by upward bending of the teeth or tongues. It is a drawback of such a construction that the teeth or tongues have a considerable bending resistance and accordingly the desired effect is not always achieved. When providing the end portions of the tongues or teeth with pointed ends which are directed towards the end of the ski and are capable of being bent upwards (French Pat. No. 22 69 358), the bending resistance of the pointed ends capable of being bent upwards may be reduced considerably because it is not the teeth or tongues themselves that must be bent upwards, however, the production of such teeth is expensive. Besides, the sliding resistance in the running direction is relatively high.

For reducing the sliding resistance in the running direction, it has been known (German Laid-Open Patent Application No. 26 10 522) to profile the running surface by milling grooves extending transversely to the longitudinal direction of the ski, wherein the milled grooves may be applied crosswise. With such milled grooves, which have only a small depth, the sliding resistance in the running direction may be improved relative to conventional scale-type skis. However, this improvement is attained at the expense of the effectiveness of the climbing aid so that such running surface structures have not been successful in practice.

Mention may be made of the aforementioned application which describes forming the running surface with a multiplicity of teeth defined by two families of parallel running surface cuts intersecting each other in the running surface, the individual families of cuts being inclined to a normal of the running surface in opposite directions. Since the running-surface cuts start from the plane running surface, the tooth backs are in the running surface, whereby improved sliding properties are ensured.

While this arrangement has proved to be a major advance in the art as noted below, and the present invention extends principles thereof, nevertheless there is a high sliding resistance when the ski is moved oppositely to the running direction because the pointed ends of the teeth are bent out of the plane of the running surface when the ski slides backwards and are again urged back into the plane of the running surface upon subsequent forward sliding movement. Since by means of the direction and size of the running-surface cuts tooth shapes with different effects may be produced in a simple way, it is possible to match the running-surface coatings to most varied conditions. Although such running surfaces have been successful in practice, it is desirable to meet different requirements with a single running-surface configuration instead of providing different running-surface shapes for different uses of the ski.

OBJECTS OF THE INVENTION

The principal object of the invention is to further develop a running-surface plastic coating for a ski with simple means so that a ski provided with such a running-surface coating may be used under different conditions with almost uniform success.

Another object of the invention is to extend the principles of the aforementioned copending application.

SUMMARY OF THE INVENTION

The invention achieves these objects in that the running surface cuts at least substantially have the shape of circular segments and include an angle of at least 60° with a running-surface normal, and that the relative spacing of the running-surface cuts is at most 1 mm.

The circular segment shape of the running-surface cuts causes different cutting depths across the cutting length so that the teeth in the marginal portion of the segment-shaped cuts are smaller than those in the portion of the arc height of the circular segments.

Thus, from the beginning the running surface is provided with teeth of different sizes, which are distributed in a predetermined way, thus permitting the desired matching to different snow conditions. Namely, the forces which prevent backsliding of the ski are in each case decisively determined by those teeth which under the given snow conditions achieve the maximum effect.

The sliding properties of the running surface in the running direction are not influenced by the different tooth heights because the tooth backs lie in the running surface itself and, irrespective of the tooth height, have the same dimensions.

The inclination of the running-surface cuts of at least 60° relative to a running-surface normal in connection with the maximum relative spacing of the running surface cuts of 1 mm ensures that the teeth have pointed ends which with ordinary materials may sufficiently be bent out of the running surface so as to provide an effective restraining effect for the ski.

The density of the teeth (i.e. the numbered teeth per unit area) is such that the individual pointed ends thereof may effectively support each other so that even after prolonged use under difficult conditions the running surface retains its shape and no teeth are torn out or deformed undesirably.

The multiplicity of teeth achieved by limiting the spacing of the running-surface cuts ensures the special restraining effect of the running-surface coating because this restraining effect increases with the number of the teeth without noticeably affecting the sliding properties in the running directions. After all, at least upon forward sliding movement the tooth backs form a common surface.

A particularly advantageous effect of the circular segment-shaped running-surface cuts is achieved when the maximum depth of the circular segment-shaped cuts, measured perpendicularly to the running surface, ranges between 0.2 mm and 1 mm. When this size is exceeded, the bending resistance of the teeth is reduced to such an extent that not only the stability of shape of the teeth but also the restraining effect thereof will suffer whereas with a depth below the specified size the restraining effect, especially of the teeth in the end region of the running-surface cuts, is reduced to such an extent that a matching to different snow conditions is no longer possible.

For increasing the number of teeth in the surface area of the running surface which is provided therefor, the relative spacing of the running-surface cuts may be reduced to 0.1 mm. A spacing below this limit causes intolerable weakening of the teeth because the teeth lose their stability of shape and can no longer offer sufficient bending resistance to the forces applied.

The angle between the running-surface cuts and a running-surface normal should at most be 80°. In connection with the predetermined maximum depth of the running-surface cuts, measured perpendicularly to the running surface, this maximum angle provides a limitation of the cutting depths of the running-surface cuts to a permissible size so that the teeth which are defined by these cuts still have an advantageous effect.

The flare angle of the pointed ends of the teeth is determined by the angle between the chords of the circular segment-shaped running-surface cuts, the individual families of which intersect each other. For ensuring advantageous conditions, the angle between the chord of the circular segment-shaped cuts and the longitudinal axis of the running surface should range between 30° and 60°.

In a further embodiment of the invention the teeth of the running surface may in a particularly simple way be produced by forming cuts in the running surface by means of at least one cutter secured to the periphery of a rotating cutter holder, whose axis of rotation includes a maximum angle of 30° with a running-surface normal.

Between two cutting steps the running-surface coating is moved relative to the axis of rotation in the longitudinal direction of the running surface by the spacing between two running-surface cuts. Because the cuts in the running surface are formed by means of a cutter which is secured to a rotating cutter holder, circular segment-shaped running-surface cuts are obtained in a simple way, the cut edge extending perpendicularly to the axis of rotation of the cutter holder.

When during one revolution of the cutter the running surface is moved relative to the axis of rotation in the longitudinal direction of the running surface by a predetermined amount, the next running-surface cut is offset by this amount of movement. Thus, it is possible by matching the rate of revolution of the cutter holder to the advance speed of the running surface to determine in a simple manner the spacing between the running surface cuts, wherein naturally only the relative movement between the running surface and the axis of rotation of the cutter holder is of importance. Nevertheless a particularly simple design is ensured by moving, instead of the cutter holder, the running-surface coating relative to the cutter holder.

The advance speed of the running surface relative to the cutter holder need not be interrupted during the cutting step. By continuously advancing the running surface relative to the axis of rotation of the cutter holder merely the angle between the chord of the circular segment-shaped running-surface cut and the longitudinal direction of the running surface is changed because the advance movement of the running surface is superposed on the rotary movement of the cutter. However, because of the considerable speed difference this change remains relatively small.

Since in its longitudinal direction the running surface of a ski has a curved extension, it is advantageous adjustably to support the cutter holder relative to the running surface so as to determine the cutting depth in a simple way.

In accordance with the principles of my earlier application included herein by reference in its totality, a running-surface plastic coating for a ski having a front end and a rear end, includes a base surface secured to the underside of the ski and a running surface directed away from the underside of the ski, the running surface being provided with a multiplicity of tongues which are aligned in the longitudinal direction of the ski and constitute the climbing aid, each tongue terminating towards the rear end of the ski in an edge extending perpendicular to the longitudinal direction of the ski and being capable of being bent upwards.

The tongues are defined by two families of parallel cuts provided in the running-surface coating and directed inwardly from the running surface toward the base surface but terminating short of the latter, the two families of cuts intersecting each other in the plane of the running surface at an angle of about 90°.

One family of cuts extends in the longitudinal direction of the ski while the other family of cuts extends perpendicular thereto. The cuts of the said other family of cuts are inclined at an acute angle to the running surface so that each tongue thereby increases in thickness from its tip in the direction and toward the front end of the ski.

In another definition of the invention, the tongues are defined by two families of parallel cuts provided in the running-surface coating and directed inwardly from the running surface toward the base surface but terminating short of the latter, the two families of cuts intersecting each other in the plane of the running surface at an angle of between nearly 0° and 180°, preferably at an acute angle of between nearly 0° and 90°.

The two families of cuts are further inclined in opposite directions at an acute angle to the running-surface and at an angle to a plane normal to the running surface to impart to each tongue a pair of rhomboidal side surfaces diverging with respect to each other from the tip of that tongue, each tongue thereby increasing in thickness from its in the direction of the front end of the ski as well as from each of its side edges in the direction of the other side edge.

BRIEF DESCRIPTION OF THE DRAWING

The above and other objects, features and advantages of the present invention will become more readily apparent from the following description, reference being made to the accompanying drawing, in which:

FIG. 1 is a simplified plan view of a running-surface plastics coating according to the invention;

FIGS. 2 and 3 are plan views of a modified design;

FIG. 4 is a plan view at an enlarged scale of the running surface showing the extension of the running-surface cut;

SPECIFIC DESCRIPTION

Figure 5:
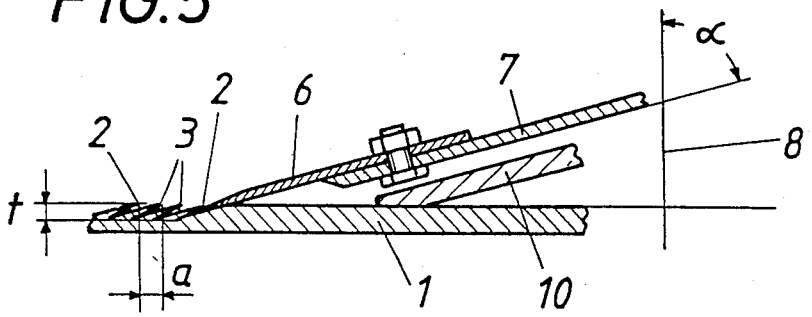
FIG. 5 is a section alon line V—V of FIG. 4 through a running-surface coating during production of the running-surface cuts.

The ski running-surface coating 1 according to the invention is provided with teeth 2 which are formed by two families of surface cuts 3 intersecting each other in the running surface. These running-surface cuts 3 have the shape of circular segments defined by a chord 4 and a circular arc 5, as shown in FIG. 4.

These circular segment-shaped running-surface cuts are formed by means of a cutter 6 which is secured to a cutter holder 7 rotating about an axis of rotation. This axis of rotation is inclined so that the running-surface cuts include an angle $\alpha$ of at least 60° and at most 80° with a running-surface normal 8.

The arrangement is such that the cutting line between the cut edge and the running surface, i.e. the chord 4, relative to the longitudinal direction 9 of the running-surface coating 1 includes an angle $\beta$ ranging between 30° and 60°. The running-surface coating 1 is continuously advanced in its longitudinal direction 9 with respect to the cutter holder 7 so that between two successive cutter actions there results a relative spacing a of the running-surface cuts 3 which ranges between 0.1 mm and 1 mm. Of course, these cuts 3 may also be formed by two or more cutters uniformly distributed about the circumference of a cutter holder disc.

In this case, the running-surface coating 1 has to be advanced in the interval between the actions of two successive cutters by the desired spacing between the running-surface cuts.

Figure 6:
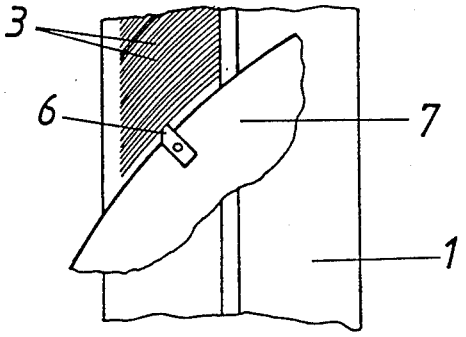
FIG. 6 is a plan view of a running-surface coating during production of a family of running-surface cuts.

This method of production yields a family of parallel cuts 3, as shown in FIG. 6. When this family of cuts 3 is superposed by a family of cuts 3 which is equally inclined relative to the longitudinal direction 9 of the running-surface coating 1 and oppositely directed, a pattern of cuts as illustrated in FIGS. 1 to 3 is obtained.

Because the families of cuts 3 intersecting each other, the teeth 2 are formed, which effectively and reliably inhibit back-sliding of the running-surface coating because the pointed ends of said teeth, which are directed towards the end of the ski, may be bent out of the running surface.

Figure 7:
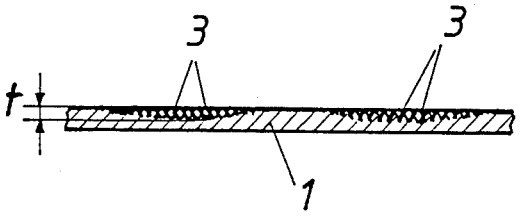
FIG. 7 is a sectional view at an enlarged scale of the running-surface coating along line VII—VII of FIG. 1.

The circular segment shape of the running surface cuts causes different cutting depths along the cuts, as shown in FIG. 4. These different cutting depths, in their turn, result in different tooth heights in a cross-section of the running-surface coating, as shown in FIG. 7.

These different tooth heights permit advantageous adaptation to different snow conditions because the tooth size which is the most favorable one for the respective kind of snow determines the restraining effect of the running-surface coating. However, these different tooth heights do not influence the sliding properties in the running direction because the backs of all teeth have the same dimensions and are in the plane of the running surface. Particularly advantageous conditions are obtained when the maximum depth t of the running-surface cuts, measured perpendicularly to the running surface, amounts to 0.2 mm to 1 mm. This depth t may be adjusted by means of a spacer 10, which is supported by the running-surface coating 1 and may be adjusted along the axis of rotation of the cutter holder 7. The radius of the peripheral path of the cutter 6 determines the circular arc 5 of the running-surface cuts and advantageously ranges between 100 mm and 200 mm.

Figure 8:
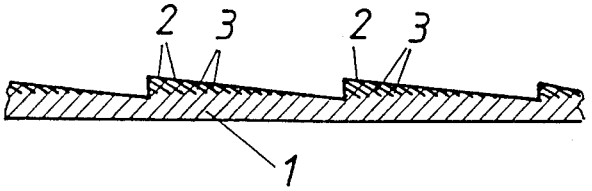
FIG. 8 is a longitudinal section through a running-surface coating having a scale-like profile.

Since cuts are made in the running surface by means of a rotating cutter 6 while the running-surface coating 1 is advanced with respect to the cutter holder in the longitudinal direction of the running surface, it is not absolutely necessary to use a plane running surface. It is also possible to provide structured running surfaces with circular segment-shaped cuts 3 so as to increase the restraining effect of such running surfaces, wherein the sliding properties are not significantly affected. FIGS. 2 and 3 show such running-surface coatings having saw-tooth-shaped scales 11, which have belatedly been provided with running-surface cuts according to the pattern of FIG. 1. FIG. 8 shows these scales 11 with the cuts in longitudinal section.

I claim:

1. In a running-surface plastic coating for a ski which comprises a running surface forming a climbing aid and having a multiplicity of teeth which are aligned in the longitudinal direction of the ski and terminate toward the rear end of the ski in a pointed end capable of being bent upwards, said teeth being defined by two families of parallel spaced-apart running-surface cuts intersecting each other in the running surface, the individual families of cuts being inclined to a normal of the running surface in opposite directions, the improvement wherein the running surface cuts at least substantially have the shape of circular segments and include an angle of at least 60° with a running-surface normal, and that the relative spacing of the running-surface cuts is at most 1 mm.

2. The improvement defined in claim 1 wherein the maximum depth of the circular segment-shaped running-surface cuts, measured perpendicularly to the running surface, ranges from 0.2 mm to 1.0 mm.

3. The improvement defined in claim 1 wherein the relative spacing of the running-surface cuts is at least 0.1 mm.

4. The improvement defined in claim 1 wherein the angle between the running-surface cuts and a running-surface normal is at most 80°.

5. The improvement defined in claim 1 wherein an angle between a chord of the circular segment-shaped running-surface cuts and the longitudinal axis of the running surface ranges between 30° and 60°.

6. The improvement defined in claim 1 wherein said families of cuts define tongues and are directed inwardly from the running surface toward a base surface at an underside of the ski but terminating short of the latter, the two families of cuts intersecting each other in the plane of the running surface at an angle of between nearly 0° and 180°, preferably at an acute angle of between nearly 0° and 90°, the two families of cuts further being inclined in opposite directions at an acute angle to the running surface and at an angle to a plane normal to the running surface and imparting to each tongue a pair of generally rhomboidal side surfaces diverging with respect to each other from the tip of that tongue, each tongue thereby increasing in thickness from its tip in the direction of the front end of the ski as well as from each of its side edges in the direction of the other side edge.

7. The improvement defined in claim 1 wherein said families of parallel cuts define tongues and are directed inwardly from the running surface toward a base surface on an underside of the ski but terminating short of the latter, the two families of cuts intersecting each other in the plane of the running surface at an angle of about 90°, one of said families of cuts extending in the longitudinal direction of the ski, the other family of cuts extending perpendicular thereto and the cuts of the said other family of cuts being inclined at an acute angle to the running surface so that each tongue thereby increases in thickness from its tip in the direction of a front end of the ski.

8. A method of producing a running-surface plastic coating as defined in claim 1 wherein cuts are made in the running surface by means of at least one cutter secured to the periphery of a rotating cutter holder whose axis of rotation includes a maximum angle of 30° with a running-surface normal, and between two cutting steps the running-surface coating is moved relative to the axis of rotation in the longitudinal direction of the running surface by a spacing between two cuts.

9. The method defined in claim 8 wherein the running-surface coating is continuously advanced with respect to the axis of rotation of the cutter holder.

10. The method defined in claim 9 wherein the cutter holder is adjustably supported relative to the running surface.

11. In a running-surface plastic coating for a ski having a front end and a rear end, which coating includes a base surface secured to the underside of the ski and a running surface directed away from the underside of the ski, said running surface being provided with a multiplicity of tongues which are aligned in the longitudinal direction of the ski and constitute a climbing aid, each tongue terminating towards the rear end of the ski in a pointed end capable of being bent upwards, the improvement wherein the tongues are defined by two families of parallel cuts provided in the running-surface coating and directed inwardly from the running surface toward the base surface but terminating short of the latter, the two families of cuts intersecting each other in the plane of the running surface at an angle of between nearly 0° and 180°, preferably at an acute angle of between nearly 0° and 90°, the two families of cuts further being inclined in opposite directions at an acute angle to the running surface and at an angle to a plane normal to the running surface and imparting to each tongue a pair of rhomboidal side surfaces diverging with respect to each other from the tip of that tongue, each tongue thereby increasing in thickness from its tip in the direction of the front end of the ski as well as from each of its side edges in the direction of the other side edge.

12. In a running-surface plastics coating for a ski having a front end and a rear end, which coating includes a base surface secured to the underside of the ski and a running surface directed away from the underside of the ski, said running surface being provided with a multiplicity of tongues which are aligned in the longitudinal direction of the ski and constitute a climbing aid, each tongue terminating towards the rear end of the ski in an edge extending perpendicular to the longitudinal direction of the ski and being capable of being bent upwards wherein: the tongues are defined by two families of parallel cuts provided in the running-surface coating and directed inwardly from the running surface toward the base surface but terminating short of the latter, the two families of cuts intersecting each other in the plane of the running surface at an angle of about 90°, the one family of cuts extending in the longitudinal direction of the ski while the other family of cuts is extending perpendicular thereto and wherein the cuts of the said other family of cuts are inclined at an acute angle to the running surface so that each tongue thereby increases in thickness from its tip in the direction of the front end of the ski.

* * * * *